United States Patent [19]

Wasserman et al.

[11] 4,180,960

[45] * Jan. 1, 1980

[54] PRESSURIZING AND CONTROLLING FLUID FLOW TO A SEALED ARTICLE

[75] Inventors: George Wasserman, 110 Babcock St., Brookline, Mass. 02146; Joseph J. Bushee, Waltham, Mass.

[73] Assignee: George Wasserman, Brookline, Mass.

[ * ] Notice: The portion of the term of this patent subsequent to Jun. 28, 1994, has been disclaimed.

[21] Appl. No.: 664,373

[22] Filed: Mar. 5, 1976

[51] Int. Cl.[2] ..... B65B 31/08

[52] U.S. Cl. ..... 53/403; 53/79; 141/329

[58] Field of Search ..... 137/224, 227; 141/329, 141/326, 328, 350, 154; 251/5, 7, 61.5, 63.6; 273/61 D; 53/7, 79, 88

[56] References Cited

U.S. PATENT DOCUMENTS 3,537,469 11/1970 Hagar ..... 137/224 X 3,720,224 3/1973 Foxhall ..... 137/227

4,031,688 6/1977 Wasserman ..... 53/7

*Primary Examiner*—Travis S. McGehee

*Attorney, Agent, or Firm*—Wolf, Greenfield & Sacks

[57] ABSTRACT

A needle attached to a valve construction is employed to cut a core from the wall of a tennis ball. A bore in the needle tip receives the core and carries it into the interior of the ball as the needle is inserted until an orifice in the side of the needle is within the ball. Gas is released from an aerosol container into a chamber within the valve construction and then into the ball through the needle orifice. A piston is disposed in the chamber and a helical spring exerts a bias force on the piston normally urging the piston toward the needle and permitting gas flow to the needle. When the pressure within the ball reaches a preselected level the piston moves away from the needle and activates a valve which shuts off the flow of gas. An indicator button external to the valve housing moves with the piston to indicate that the preselected pressure has been reached. The needle is then withdrawn from the ball leaving the core to reseal the hole.

7 Claims, 4 Drawing Figures

FIG. 1
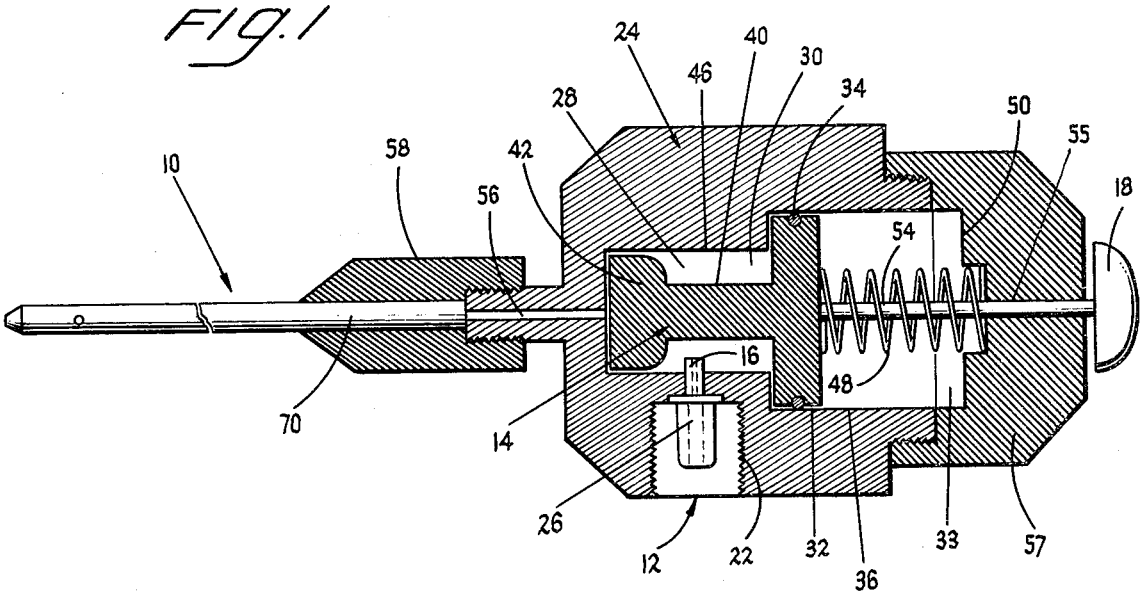
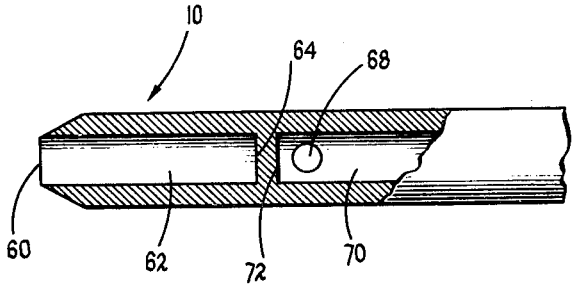
FIG. 2
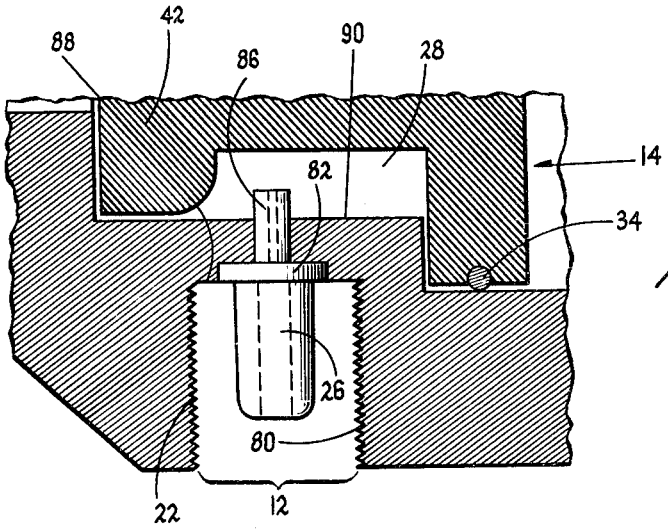
FIG. 3

PRESSURIZING AND CONTROLLING FLUID FLOW TO A SEALED ARTICLE

BACKGROUND OF THE INVENTION

The invention in general relates to controlled, pressurized fluid flow and more particularly concerns a method and apparatus for pressurizing sealed articles such as tennis balls and controlling the passage of a fluid from a pressurized container to the sealed article in a manner that is efficient and provides a signal when a preselected pressure is reached.

It is important in the playing of tennis to use balls that are of uniform and regular characteristics. The resilience and the size of the ball are partly dependent on the internal pressure of the ball. For example, a lower internal ball pressure will reduce the bounce of the ball while a higher pressure will increase its bounce and also may tend to enlarge the diameter of the ball slightly, particularly when in play. Changes from the desired internal pressure (approximately 15 p.s.i) can result from a number of causes, perhaps the most common being repetitive use. Additionally, changes in atmospheric conditions (e.g. pressure or temperature) also can effect these characteristics of the ball. Further, prolonged shelving of the ball, even in stable atmospheric conditions, tends to result in a ball with reduced bounce and less liveliness.

Application Ser. No. 610,128, filed Sept. 4, 1975 shows an apparatus for pressurizing tennis balls which comprises a needle having a sharp forward end adapted to puncture a tennis ball in which the pressure is to be changed and having a passage in its rear portion which terminated in an orifice in the side of the needle, through which orifice gas such as air could be introduced or withdrawn from the ball as desired. The forward end of the needle carried a resilient plug which entered the ball with the needle and upon the withdrawal of the needle frictionally engaged the walls of the ball so that it effected a seal of the hole after the needle was withdrawn. Each use required the preloading of a needle with a sealing plug. This preloading and the possibility of losing or running out of sealing plugs are distinct disadvantages of this technique.

Accordingly one object of this invention is to provide a device for pressurizing a hollow member such as a tennis ball by using a cone cut from the ball wall upon insertion of the needle into the ball as a sealing plug.

Application Ser. No. 610,128 also shows a method of controlling gas flow to the needle utilizing an aerosol can of gas in combination with a valving arrangement which vented the gas to the atmosphere when the proper ball pressure was reached. Thus, a disadvantage of this technique was that gas continued to flow from the aerosol can as long as the can was maintained in the valve-open position. In accordance with this invention this problem is overcome by stopping the gas flow from the can upon reaching the proper pressure thereby not wasting gas and requiring often replacement of the aerosol can. Furthermore, in accordance with this invention a signal is provided to indicate that the proper pressure has been reached. This signal is preferably a visible signal. The operator then can withdraw the needle immediately upon receipt of the signal.

Accordingly, it is an object of this invention to provide an improved method and apparatus for pressurizing sealed, hollow articles that overcome one or more disadvantages of previous pressurizing techniques.

It is another object of this invention to provide a needle design that overcomes one or more disadvantages of previous needles used in pressurizing techniques.

It is still another object of this invention to provide a pressurizing technique for use with a hollow article and providing means for using a cone of the member as a sealing plug.

It is a further object of this invention to achieve one or more of the preceding objects with a pressurizing-sealing needle that eliminates the need for preloading a sealing plug and avoids the possibility of losing or running out of sealing plugs.

It is another object of this invention to achieve one or more of the preceding objects with a valving method and apparatus that overcomes one or more disadvantages of previous methods of controlling the flow of gas to a needle.

It is another object of this invention to provide a valving system which stops the flow of gas from a gas source even though the source is still capable of expelling gas.

It is still another object of this invention to achieve one or more of the preceding objects with a valving system that automatically stops the flow of gas from an aerosol can when the proper pressure is reached.

It is a further object of this invention to achieve one or more of the preceding objects with a valving system that provides a visual signal that the proper pressure has been reached in a pressurizing system.

It is another object of this invention to achieve one or more of the preceding objects with a tennis ball pressurizing system that is more economical than previous systems.

It is yet another object of this invention to achieve one or more of the preceding objects with a tennis ball pressurizing system that is faster and more reliable than previous systems.

SUMMARY OF THE INVENTION

According to the invention there is a needle attached to a valve construction for controlling the flow of a fluid from a source of pressurized fluid to a fluid passage in the rearward portion of the needle. A sharp cutting edge on the free (forward) end of the needle is employed to cut a cylindrical core from the wall of an article, such as a tennis ball, which is to be pressurized. A cylindrical bore within the needle, extending from the free end axially along its length and terminating at an end wall, accepts the core and carries it into the interior of the article as the needle is inserted into the article. The gas passage in the rearward portion of the needle extends axially along its length to an orifice located in the side of the needle. The needle is inserted into the hole formed in the wall of the article until the orifice is within the article. The valve construction includes a valve housing defining a piston chamber and at least two openings one of which preferably is a threaded bore for receiving a gas source. A piston is slidably disposed in the piston chamber. A bias means is provided preferably, a helical spring, for applying a preselected bias force to the piston urging it toward the needle end of the valve housing. Fluid, preferably a gas, is released from the source, preferably an aerosol container, and the pressure rises in the pressurizable region of the piston chamber (and in the article to be pressurized which communicates with it through the needle) until the pressure reaches a preselected level determined at least in part by the bias means whereupon the piston moves away from the needle. There is shut-off valve means activated by the movement of the piston which shuts off the gas flow from the source. Preferably the shut-off valve means comprises a pliable tube, one end of which is coupled to the neck of the aerosol container and the other end of which extends through the valve housing and into the pressurizable region of the piston chamber, and a snubber disc which may be integral with the piston and which slidably contacts the walls of the piston chamber. As the piston moves away from the needle the snubber disc pinches the pliable tube to terminate the flow of gas. Preferably there is an indicator means activated by the movement of the piston to produce a signal external to the valve housing indicating that the preselected pressure level has been reached. When the pressure level is reached the needle is withdrawn from the ball whereupon the core carried in the forward end of the needle frictionally engages the wall of the ball and remains in the hole sealing it.

Numerous other features, objects and advantages of the invention will now become apparent from the following detailed description when read in connection with the accompanying drawings, in which:

BRIEF DESCRIPTION OF THE DRAWINGS

FIG. 1 is a diagrammatic cross-sectional illustration of an exemplary embodiment of the invention;

FIG. 2 is an enlarged fragmentary cross-sectional view of the preferred embodiment of the needle;

FIG. 3 is an enlarged cross-sectional illustration of the preferred embodiment of the shut-off valve.

DETAILED DESCRIPTION OF THE PREFERRED EMBODIMENT

Figure 4:
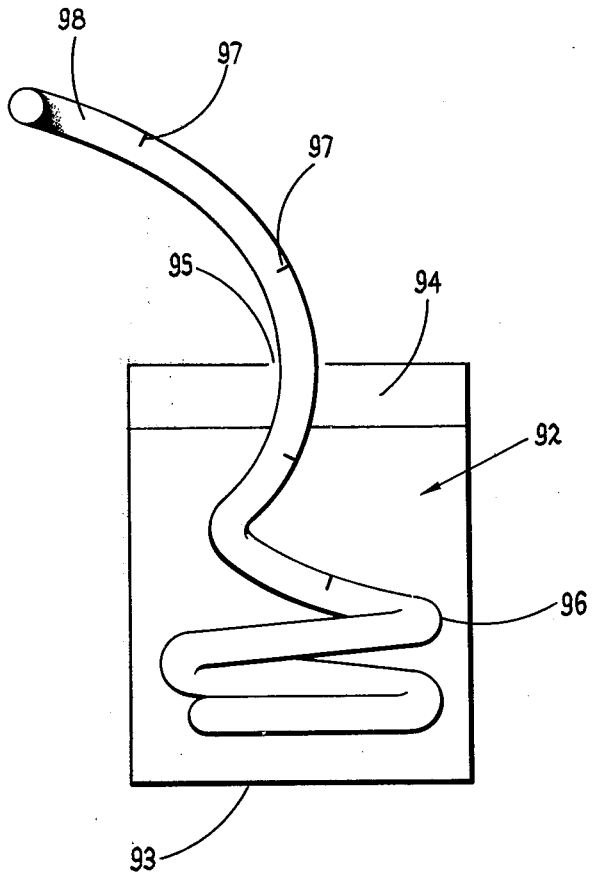
FIG. 4 is an enlarged view of a container for a resilient string from which plugs may be taken.

With reference now to the drawing and more particularly FIG. 1 thereof, there is shown a diagrammatic cross-sectional illustration of the device, according to the invention, for adjusting the pressure in tennis balls. Needle 10 is inserted in a ball, gas is injected through source opening 12 until a preselected pressure level is reached whereupon piston 14 moves to the right pinching tubing 16 to shut-off the gas flow and also extending button 18 to indicate that the needle may be removed from the ball.

The system is pressurized by means of an aerosol container (not shown) which is screwed into threaded bore 22 in valve housing 24. The aerosol can is of conventional design and once it has been screwed into bore 22 can be easily activated by tipping the can so that its neck tips relative to the body of the can. It is actually the neck of the aerosol can that is screwed into bore 22. Pliable coupling 26 engages the neck of the aerosol can and transmits the gas into pressurizable region 28 of piston chamber 30. The gas is free to pass around disc 42 of piston 14 through passage 56 and into passage 70 in needle 10 which is attached to housing 24 by bushing 58. Needle 10 and bushing 58 may be a single piece. Large end 32 of piston 14 pneumatically separates pressurizable region 28 from region 33. O-ring 34, secured in a groove in the circumference of end 32, slidably contacts the walls of the larger section 36 of the cylinder chamber bore. The core 40 of the piston 14 connects end 32 to snubber disc 42. In the preferred embodiment snubber disc 42 fits loosely in the smaller section 46 of the cylinder chamber bore so that gas may pass around it, however it is not so loose fitting that it has substantial sideplay; typically the radius of the disc may be 0.372 inches while the radius of the smaller bore section may be 0.375 inches. Helical spring 48 is compressed between piston end 32 and piston chamber end wall 50 to provide a preselected bias force holding piston 14 away from region 33. When the difference between the pressure in the pressurizable region 28 and the region 33 becomes greater than the bias pressure of spring 48, piston 14 moves to the right forcing disc 42 against pliable tubing 16 to pinch off the flow of gas. The movement of the piston 14 also pushes rod 54 which is secured thereto. Rod 54 extends through vent opening 55 in valve cap 57, to move button 18 away from valve cap 57 to indicate that the preselected pressure level has been reached. In the embodiment of the invention used in pressurizing tennis balls, helical spring 48 is selected so as to yield a preselected pressure level of approximately 15 p.s.i. Rod 54 also acts as a spring guide to maintain the radial position of spring 48 substantially in the center of piston 14.

Referring now to FIG. 2 there is shown an enlarged cross-sectional view of the forward portion of the needle. When the needle is pressed against the ball, sharp cutting edge 60 cuts a cylindrical core from the wall of the ball which is accepted by cylindrical bore 62 extending axially along the needle and terminating at end wall 64. The core is held by the bore with a small portion of it protruding out beyond the needle tip and is carried into the interior of the ball as the needle is inserted until orifice 68 is located within the ball. Gas may then enter the ball through passage 70 which communicates with orifice 68 and terminates at end wall 72. When the indicator button on the valve housing pops outward the needle is removed from the ball and the portion of the core protruding from the needle tip is frictionally engaged by the ball walls so the core is removed from the bore and is grasped by the walls to effectively seal the hole.

The shut-off valve employed in the valve construction is shown in enlarged diagrammatic cross-section in FIG. 3. This shut-off valve is adapted to receive the neck of an aerosol type container that is in common use. For purposes of this invention one would preferably use such containers containing pressurized air or some other non-toxic gas. The neck of the container is commonly provided with a threaded exterior known as a "speed thread." Bore 22 is threaded to readily receive the "speed thread" of the aerosol container and it is in fluid communication with region 28 through pliable tubular coupling 26. Preferably opening 12 is a cylindrical bore 22 fitted with a threaded sleeve 80 which secures coupling 26 in position by seating against coupling flange 82. In the preferred embodiment coupling 26 comprises a natural rubber tube having a wider diameter end 84 which engages the neck of an aerosol container screwed into opening 12 and a narrower diameter end 86 which extends through end wall 88 of bore 22 and protrudes slightly above relatively hard, smooth surface 90. Gas flowing through coupling 26 is interrupted when snubber 42 slides across surface 90 to pinch end 86 of the rubber tube.

It should be noted that the shut-off valve described herein greatly increases the usefulness of the common variety aerosol container. Typically the contents of the container is released by twisting the container (or neck of the container) so that the neck of the container and the body of the container form a slight angle. The contents of the container continue to release until the container (or neck) is released. Therefore in any pressurizing application requiring a specific pressure within the article to be pressurized it is easy and often necessary to overinflate the article thereby wasting gas and requiring subsequent steps of testing the pressure and then releasing the excess. The shut-off valve of this invention stops the gas flow when the proper pressure is reached even when the container (or container neck) continues to be held in the release position, thus promoting accuracy of inflation, conservation of gas, and efficiency of operation.

While the invention has been illustrated thus far by an embodiment useful for reconditioning tennis balls by increasing their internal pressure, it should be understood that the invention is not limited solely to such use. It may be used, for example, for pressurizing new tennis balls or other articles which have at least one pliable wall in which a small hole is or may be formed. The valve construction described herein may be used in combination with other types and configurations of needles such as those shown in application Ser. No. 610,128. Further the valve construction may be used independent of a needle in applications such as pressurizing pneumatic tires to a preselected pressure level. Also, the needle described herein can be used in combination with a syringe or other valve constructions.

FIG. 4 shows a container 92 which is preferably of cylindrical shape having a side wall, a bottom 93 and a top 94. The top 94 has a flat surface with a circular aperture 95 therethrough. A coil of a resilient rubber thread or string 96 is disposed in the container 92 and has its end extending out of the container through the aperture 95. The string 96 is constructed of a resilient rubber material and in accordance with the invention has a number of slight cuts 97 disposed therealong preferably in equal spaced segments.

Previously when plugs were to be used the individual plugs were contained in a container like container 92. However, many times these plugs were difficult to handle because of their size. However, with the arrangement of FIG. 4 one can simply pull on the end 98 holding a spot therebelow, and because the member is cut at 97 the proper predetermined plug is formed each time. The cuts 97 define each separation of the member into the individual plugs.

Although in the preferred embodiment disclosed herein the plug has been cut from the ball itself, it is also possible to use a plug cut from the string 96 shown in FIG. 4. The plug is inserted into the opening in the end of the needle prior to the device being inserted into the article.

There has been described a novel method and apparatus for pressurizing sealed articles with speed and accuracy and having numerous other features. It is evident that those skilled in the art may now make numerous uses and modifications of and departures from the specific embodiment described herein without departing from the inventive concepts. For example, the device can also be used for the manufacture of new articles. In this case the device is used to puncture and pressurize the ball, after vulcanization and prior to attaching the felt cover. The invention is to be construed as embracing each and every novel feature and novel combination of features present in or possessed by the apparatus and method herein disclosed.

What is claimed is:

1. A method of adjusting the pressure within a tennis ball using a hollow-tipped needle and pressure source comprising:

cutting a cylindrical core from the wall of said ball with said needle, urging said core from the wall to the inside of the ball by holding the cut core in the tip of the needle, flowing gas from the pressure source through the hole formed by the removal of said core thereby altering the pressure in the ball, and sealing the hole with said core by withdrawing the needle causing the cut core to frictionally engage the hole in the wall.

2. A valve construction for controlling fluid flow from a pressurized source to an article to be pressurized comprising, a housing defining an internal chamber including an inlet passage adapted to be connected to a pressurized gas source and an outlet passage adapted to be connected to an article to be pressurized, valve means within said housing for passing gas through said housing from said inlet to said outlet passage until a preselected pressure within said housing is reached and visual indicating means operatively connected to said valve means for visually displaying a signal external of said housing when said preselected pressure within said housing is reached, said valve means comprising a valve member disposed intermediate the inlet and outlet passages and piston means in said internal chamber responsive to the pressure to coact with the valve member, said indicating means being operatively connected to the piston means, whereby upon coaction of the valve member and piston means, the indicating means displays said signal.

3. A valve construction in accordance with claim 1 wherein, said piston chamber comprises two cylindrical bores of different diameter extending in opposite directions along the same axis, having an open end in common, and each terminating at an end wall, said inlet passage includes a cylindrical, threaded bore and a coupling; said threaded bore being open at its outer end, extending into said valve means in a direction normal to the circumference of said piston chamber, and terminating at said coupling, said coupling comprising a pliable tube means having a larger diameter end which protrudes axially into said threaded bore and is engageable with the neck of a gas supply container and a smaller diameter end which extends through the wall of said housing and protrudes slightly into said piston chamber on said one side of said piston, said piston comprises a piston disc and an O-ring fixed in a groove in the circumference of said piston disc; said O-ring slidably contacting the wall of said piston chamber bore of larger radius, said valve comprising a snubber disc forming the other end of said piston and said pliable tube means protruding into said piston chamber on said one side of said piston; said snubber disc slidably contacting the wall of said piston chamber bore of smaller radius and means rigidly connecting said snubber disc to said piston disc so that as said piston moves towards said vented region said snubber disc pinches said pliable tube means to shut-off said fluid flow, bias means comprising helical spring one end of which engages said piston and the other end of which engages the end wall of said piston chamber bore of larger radius, said indicator means comprising a rod fixed to the center of said piston disc and extending axially from said piston disc, passing axially through said helical spring then through the end wall of said piston chamber and protruding slightly from said valve housing, and a button fixed to the external end of said rod so that as said piston moves towards said vented region said button pops away from said housing to provide an external visual signal that said preselected pressure level has been reached.

4. A valve as set forth in claim 2 wherein said valve member is connected to said inlet passage whereby gas from said inlet passage will pass through said valve, said piston means slidably disposed in said chamber adapted to move to and away from closing engagement with said valve whereby the flow of gas is stopped when said piston engages said valve and said gas is permitted to flow from said inlet passage into said chamber on one side of said piston and out through said outlet passage into an article to be pressurized when said valve and piston are disengaged, means biasing said piston in a direction away from said valve, said biasing means exerting a preselected force on the other side of said piston whereby said piston is moved toward engagement with said valve when the pressure of said gas exerts a force on said one side of said piston which exceeds said preselected force on the other side of said piston, thereby stopping gas flow through the source.

5. A valve construction for controlling fluid flow from a pressurized source to an article to be pressurized comprising, a housing defining an internal chamber including an inlet passage adapted to be connected to a pressurized gas source and an outlet passage adapted to be connected to an article to be pressurized, a valve means within said housing for passing gas through said housing from said inlet to said outlet passage until a preselected pressure within said housing is reached and visual indicating means operatively connected to said valve means for visually displaying a signal external of said housing when said preselected pressure within said housing is reached, said valve means comprising a piston means and a flexible coupling disposed in the inlet passage and having an end extending into the internal chamber for closure upon contact by said piston means.

6. A valve construction in accordance with claim 5 wherein the piston comprises opposite end sections and a middle section of reduced size to form a pressurized area whereby a force can be applied to one end of the piston to keep the valve means open.

7. A valve construction in accordance with claim 6 wherein one end section of the piston is sized so that gas can flow thereabout to the outlet passage.

* * * * *